US006468592B1

(12) United States Patent
Becker et al.

(10) Patent No.: US 6,468,592 B1
(45) Date of Patent: Oct. 22, 2002

(54) APPLYING A PIGMENT COATING TO A PAPER OR CARDBOARD STRIP

(75) Inventors: Ingo Becker, Köln; Bernd Bohnenkamp, Düsseldorf, both of (DE)

(73) Assignee: Jagenberg Papiertechnik GmbH, Neuss (DE)

( * ) Notice: Subject to any disclaimer, the term of this patent is extended or adjusted under 35 U.S.C. 154(b) by 0 days.

(21) Appl. No.: 09/485,776

(22) PCT Filed: May 30, 1998

(86) PCT No.: PCT/EP98/03251

§ 371 (c)(1),
(2), (4) Date: Feb. 15, 2000

(87) PCT Pub. No.: WO99/09253

PCT Pub. Date: Feb. 25, 1999

(30) Foreign Application Priority Data

Aug. 15, 1997 (DE) ..... 197 35 588

(51) Int. Cl.[7] ..... B05D 1/30

(52) U.S. Cl. ..... 427/420; 118/325; 118/DIG. 4; 118/410

(58) Field of Search ..... 118/325, DIG. 4, 118/410; 427/420, 402, 411

(56) References Cited

U.S. PATENT DOCUMENTS 4,559,896 A * 12/1985 Bossard et al.
4,974,533 A * 12/1990 Ishizuka et al.
5,395,660 A * 3/1995 Ruschak et al.

* cited by examiner

*Primary Examiner*—Brenda A. Lamb
(74) *Attorney, Agent, or Firm*—Herbert Dubno; Andrew Wilford

(57) ABSTRACT

A web is coated by passing it in a horizontal web travel direction beneath a slot nozzle extending transversely of the direction. A pigment-carrying liquid is ejected at a flow speed from a slot of the nozzle to form a downwardly free-falling curtain extending across the web. A vertical inner face of a guide element is oriented at each outer edge of the curtain with each face extending from a respective end of the slot downward to adjacent the passing web. An upper region of each of the inner faces is fed is to a respective partial stream of the liquid such that the partial streams flow down the respective inner faces at a speed at least equal to the curtain flow speed and merge with the outer edges of the curtain.

20 Claims, 5 Drawing Sheets

APPLYING A PIGMENT COATING TO A PAPER OR CARDBOARD STRIP

CROSS REFERENCE TO RELATED APPLICATIONS

This application is the US national phase of PCT application PCT/EP98/03251 filed May 30, 1998 with a claim to the priority of German application 19735588.9 filed Aug. 15, 1997.

FIELD OF THE INVENTION

In order to finish a paper or cardboard web it is known to coat it with a water-base layer of pigment. The pigment layer contains as pigment chalk, calcium carbonate, and the like with additives such as CNC, starch, and the like.

Parent German application 197 16 647 describes a method and apparatus for applying a pigment coating to a paper or cardboard web where the coating(s) having a particle content by weight of 30% to 72% is applied to the web as a free-falling curtain by a slot nozzle arranged transversely above the web-travel direction. The application from a free-falling curtain has the advantage that no extra is applied so as not to overload a following dosing element to produce a light application. In order to prevent a thinning of the edges of the free-falling curtain according to one embodiment both ends of the slot of the slot nozzle are provided with guide elements extending down to near the web and serving to prevent thinning of the edges of the free-falling curtain. Sheet-metal guide elements are preferred.

BACKGROUND OF THE INVENTION

A typical method of applying a pigment coating to a paper web with a free-falling curtain is known from European 0,517,223. In this publication there is no discussion of how to deal with the problem of the curtain thinning.

In order to stabilize a free-falling liquid curtain while coating a passing web, European 0,115,621 describes arranging to both sides of the curtain so-called curtain maintainers that are provided along their entire vertical length with a manifold passage and output for directing a secondary liquid toward the curtain. The secondary liquid forms a triangular and flat stabilizing liquid bridge between the curtain and the curtain maintainers. The described method deals with coating of PE-coated paper with glycerine or aqueous gelatins for producing films, not for applying a pigment-containing coating dye.

OBJECTS OF THE INVENTION

It is an object of the invention to improve on stability and uniformity of the curtain in the known method of applying a pigment coating to a paper or cardboard web.

A further object is to provide an apparatus for carrying out the method according to the invention.

SUMMARY OF THE INVENTION

These objects are attained according to the invention in a method wherein a web is passed in a horizontal web travel direction beneath a slot nozzle extending transversely of the direction. A pigment-carrying liquid is ejected at a flow speed from a slot of the nozzle to form a downwardly free-falling curtain extending across the web. A vertical inner face of a guide element is oriented at each outer edge of the curtain with each face extending from a respective end of the slot downward to adjacent the passing web. An upper region of each of the inner faces is fed to a respective partial stream of the liquid such that the partial streams flow down the respective inner faces at a speed at least equal to the curtain flow speed and merge with the outer edges of the curtain.

BRIEF DESCRIPTION OF THE DRAWING

The drawing serves for explaining the invention with reference to simplified illustrated embodiments wherein.

SPECIFIC DESCRIPTION

Figure 3:
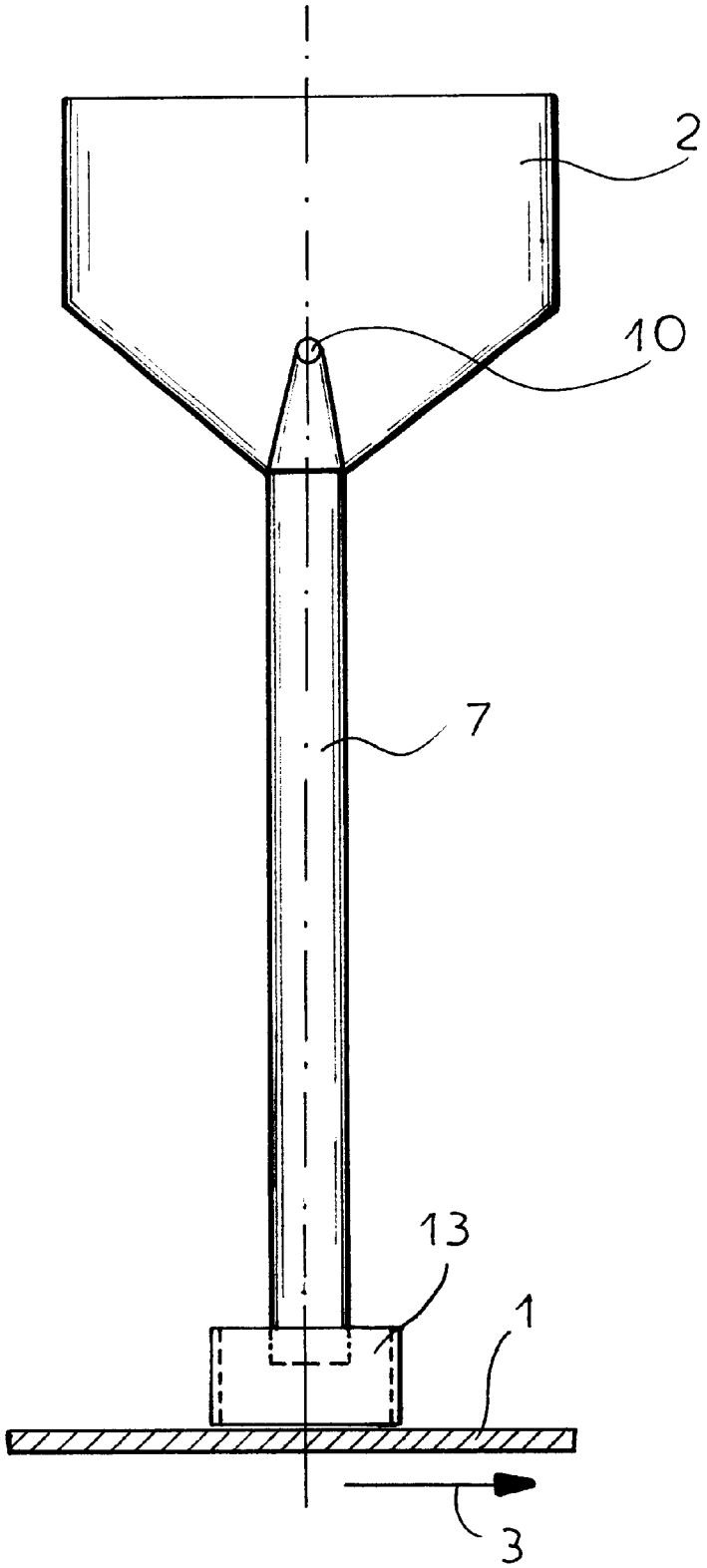
FIG. 3 is a side view of the structure of FIG. 2.

The apparatus shown in the figures serves to apply a water-base pigment layer with a particle content of 30% by weight to 72% by weight, preferably 45% to 70%, to a paper or cardboard web 1. Its main part is a slot nozzle 2 that is suspended in the frame of the apparatus perpendicular to the web-travel direction (arrow 3 in FIG. 3). The slot nozzle 2 is connected to an unillustrated coating-material supply and has on its underside a slot-shaped outlet 4 from which the coating material exits and forms a free-falling curtain 5 that drops on the top surface of the web 1. The slot nozzle 2 is vertically adjustable in order to be able to set the spacing of the outlet 4 from the web 1 and thus set the distance the coating material drops. Preferably the drop is set between 20 mm and 500 mm, in particular between 100 mm and 200 mm. Below the slot nozzle 2 the web 1 is passed around a deflecting roller 6 and is guided so that it runs very smoothly and coating variations on contact of the curtain 5 with the web 1 are avoided.

At each of the two ends of the slot nozzle 2 there is directly adjacent the outlet slot 4 a respective guide element 7 that extends downward to adjacent the web 1. Each guide element 7 serves to guide and spread the edge of the curtain 5 in order to counteract thinning caused by surface tension.

Each guide element 7 is flat on its inner side 8 turned toward the curtain, preferably the inner face 8 is planar with a width measured parallel to the web-travel direction 3 of more than 10 mm, preferably about 20 mm. Alternatively it is also possible to form the inner face 8 concave or convex with the center of curvature running vertical. The inner face 8 of the guide element 7 runs from the nozzle 2 to the web 1 at an angle between 0° and 10° to the middle of the curtain 5. Preferably each guide element 7, as shown in the figures, is made rigid. If necessary to stabilize the curtain 5 so that the angle of the inner face 8 is set in discreet regions dependent on the coating material being applied, either the entire guide element 7 or only its inner face 8 is made flexible. In order to set the desired curvature of the inner face 8 adjusters are applied to the guide element 7. Flexibly constructed guide elements 7 make it possible to spread the curtain 5 before it contacts the web 1 additionally in order to thin the edges. To this end the guide elements 7 are bent out in lower regions.

The lower edge of each guide element 7, which forms the end of the inner face 8, is preferably formed as a splitter edge 9 so that the end of the curtain 5 leaves the guide element 7 in a defined flow without undesired outward deflection. The splitter edge 9 eliminates the so-called "tea-pot effect" which causes a partial deflection of the curtain edge around the underside of the guide element 7.

Above the outlet slot 4 each guide element 7 has a throughgoing bore that serves as guide conduit 10 for feeding a separate partial stream of coating material to the inner face 8. Externally the feed conduit 10 is connected by means of a respective line and a control valve to a material-supply system of the slot nozzle 2 so that the size of the partial flow stream of coating material fed to the guide element 7 as helper liquid can be adjusted. Internally the conduit 10 opens at the upper portion of the outlet slot 4 onto a vertically downward extending feed passage 11 about 20 mm long and having an outlet level with the outlet slot 4 of the slot nozzle 2 immediately adjacent same. The feed passage 11 is easily formed by making a groove in the inner face 8 of the guide element 7 in the region of the slot nozzle 2 and reaching to the bore 10, the groove being laterally closed when the guide element 7 is secured on the end of the nozzle 2.

It is important for the invention that the partial stream of coating material fed from above to the guide element 7 and flowing down on the inner face 8 where it contacts the edge of the curtain 5, for example when leaving the feed passage 11 level with the outlet slot 4, flows substantially vertically downward and that the rate of flow of the partial stream is at least as great as the outlet speed of the coating material from the nozzle 2. These two requirements ensure that nothing destabilizes the curtain 5 by slowing its edges on the guide elements 7 relative to the drop speed of the curtain 5 at its center. The curtain 5 is spread at its edges from the cohesion and adhesion forces that on the one hand are effective between the material of the partial streams and the inner faces 8 of the guide elements 7 and on the other hand between the material of the curtain 5 and their partial streams. The inner faces 8 are thus made such that they are easily coated by the coating material. Transverse forces are effective on the edges of the curtain 5 without influencing its stability by slowing its drop speed or by transverse flow at the edges.

The use of partial streams of the coating material as helper liquid at the edges has on the one hand the advantage that sufficiently great cohesion forces are effective between the helper liquid and the coating liquid of the curtain 5 and on the other hand the ability to recirculate the helper liquid as coating liquid when a curtain 5 is produced that is wider than the desired coating width of the web 1. A wider curtain 5 is preferably used in order to achieve a uniform application across the actual coating width. As described more closely below, then the curtain edges at which the curtain 5 is thicker are separated before contacting the web 1 so that a uniform curtain 5 with the desired coating width falls on the web 1.

Preferably each guide element 7 has an internal empty cavity 12 that extends longitudinally over the region of the inner face 8 in contact with the coating liquid. In operation a coolant is fed via fittings into the empty cavity 12 so that cooking-on of the coating material is avoided. To this end the inner face 8 is cooled to a temperature that is about 15° C. less than the temperature of the coating liquid.

Figure 5:
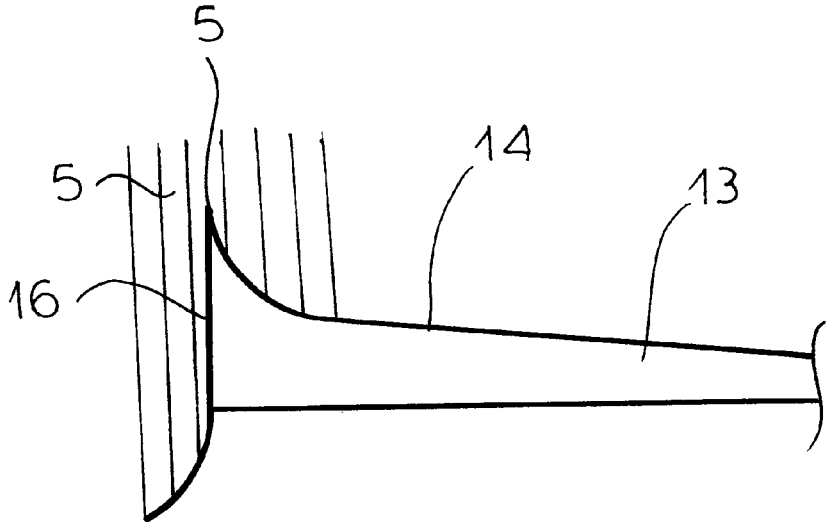
FIGS. 5 and 6 show alternative embodiments of an element for separating the curtain edge.

In the region of each curtain edge there is between the lower edge of the guide element 7 and the web 1 a separator element 13 that extends from outside into the region of the web 1. Each separator element 13 covers the respective free edge of the web 1. Preferably each separator element 13 is shiftable transversely of the web-travel direction in order to be able to set its position on the web and the width of the edge to be kept clear, which can go to zero. Each separator element 13 has an upper intercepter surface 14 that preferably is inclined downward and outward so that the coating material landing on it runs outward. Toward the center of the curtain the intercepter surface 14 is curved upward to a sharp splitter edge 15 that cuts like a blade through the curtain 5 at the desired location. The end of the guide element 13 turned toward the curtain center is formed by a guide surface 16 which extends vertically or to reduce the danger of separation of the curtain 5 at a slight angle to the center of the curtain. The upper end of the guide surface 16 forms with the interceptor surface 14 the splitter edge 15. The lower end immediately above the web 1 forms in the simplest form a right-angle edge with an outwardly extending lower wall 17 as shown schematically in FIG. 5.

Figure 1:
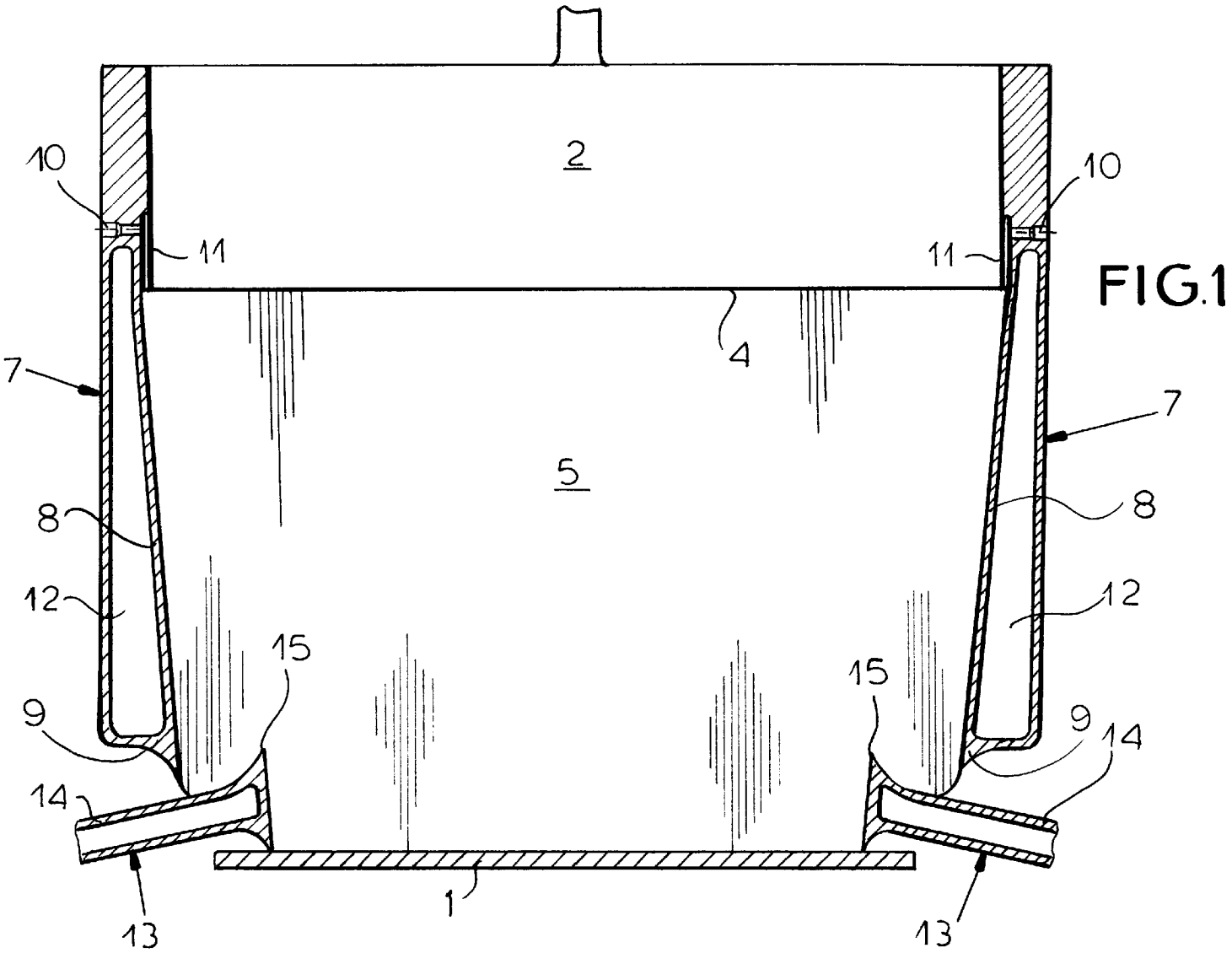
FIG. 1 is a cross-section through a coating apparatus transverse to the web-travel direction.
Figure 2:
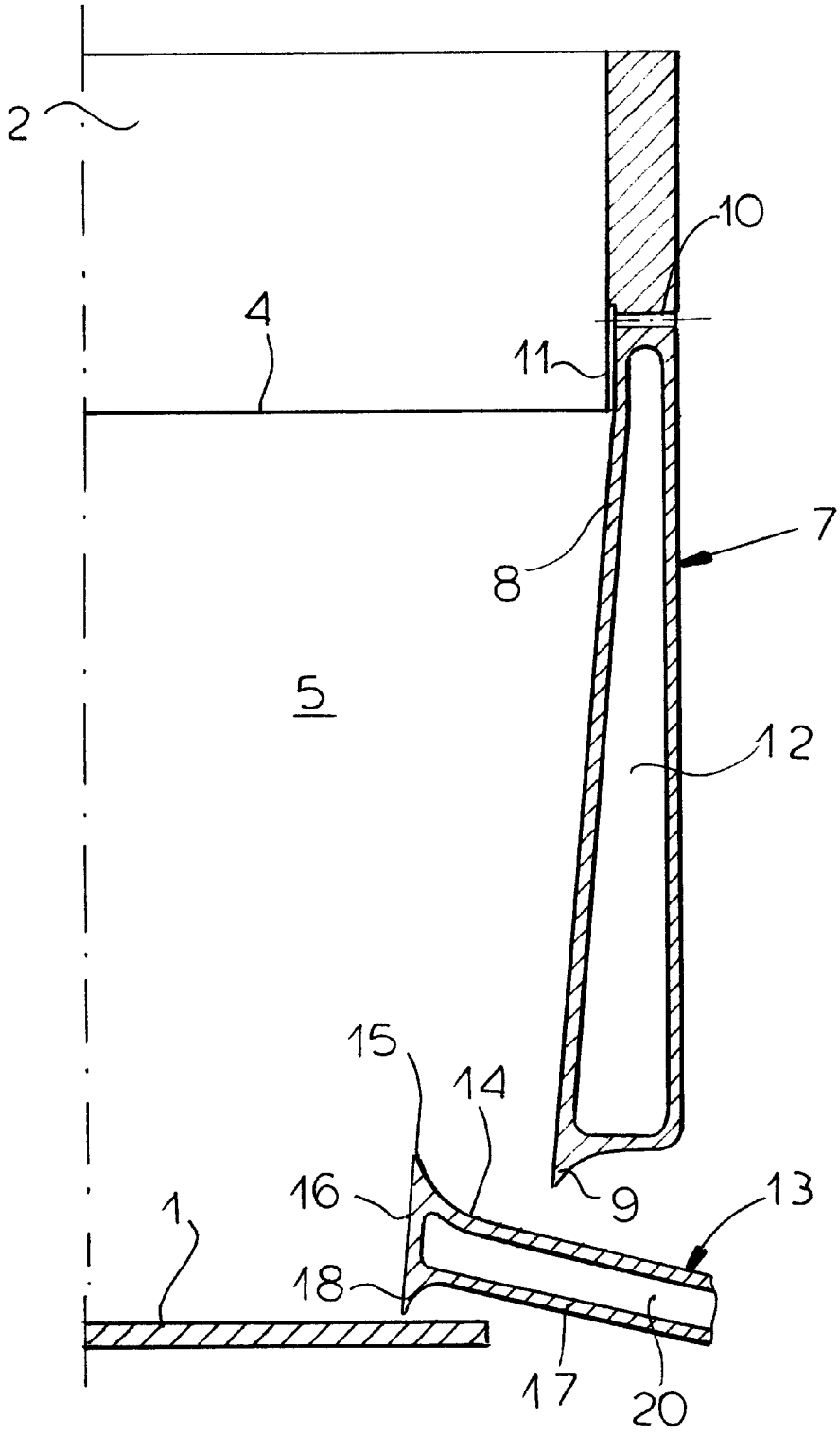
FIG. 2 is an enlarged view of the edge region of FIG. 1.
Figure 4:
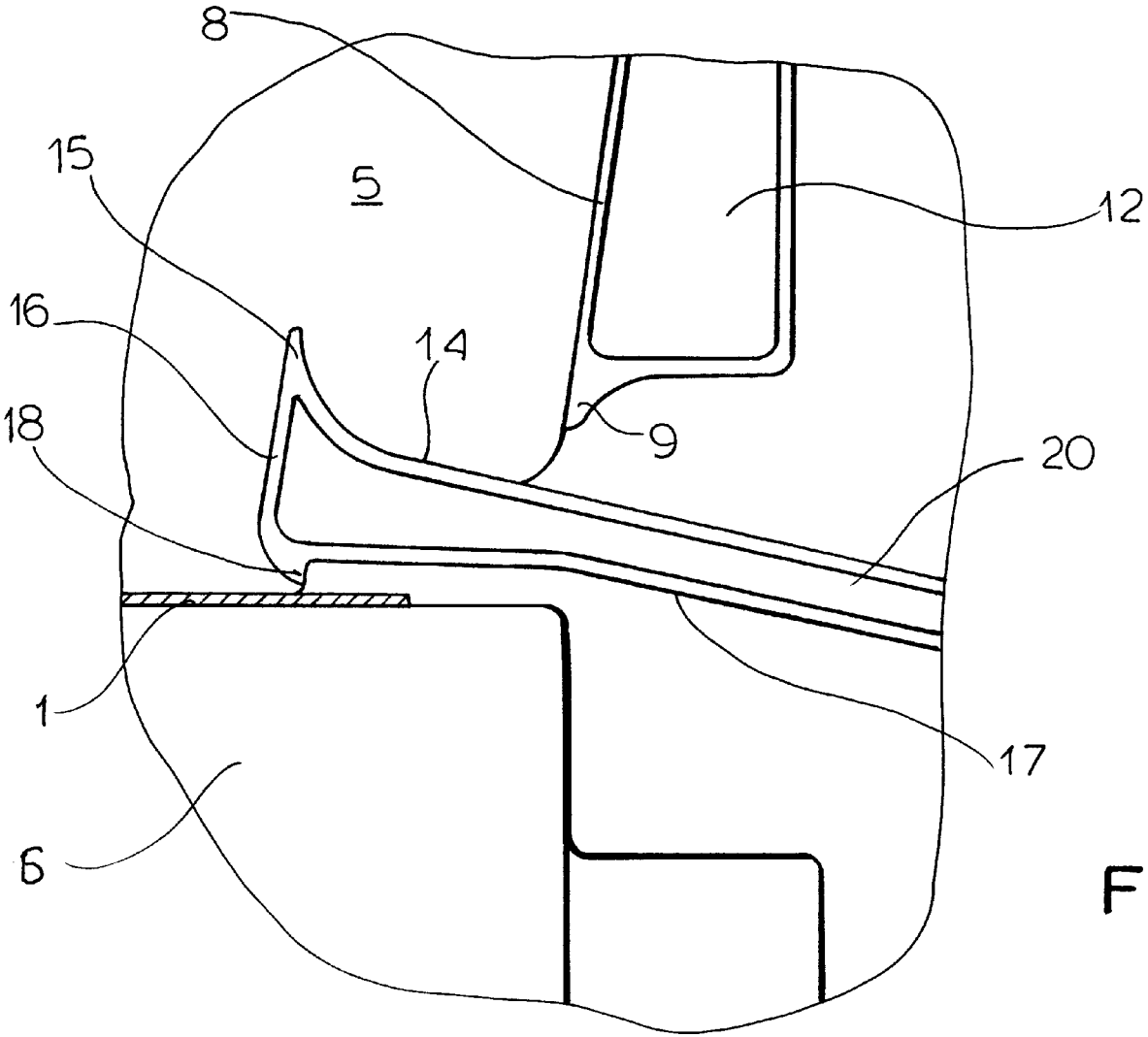
FIG. 4 is in a further enlarged view the edge region in the contact zone of the curtain on the web.

The preferred embodiment of the inner guide surface 16 of the separator element 13 is shown in FIG. 4: With this embodiment the guide surface 16 is outwardly curved in its lower region and terminates at its lower edge in a sharp splitter edge 18. From the outwardly curved part the curtain edge flowing over the guide surface 16 is spread outward, that is pulled apart, without any danger of separation. The spreading reduces the thickness of the curtain edge so that the layer applied to the web 1 of coating liquid is uniformly thick to the edge of the coating, at least having no unacceptable hard-to-dry spots on the web edges. The sharp splitter edge 18 prevents the teapot effect whereby the coating liquid runs from the guide surface 16 to the underside of the lower wall 17 and drips uncontrolledly downward from this part. This leads to spotting of the web edges and/or of the guide roller 6. If the curtain does not need to be spread between the lower splitter edge 18 and the web 1, the guide surface 16 can run at a right angle into the splitter edge 18 as shown in FIG. 2.

Figure 6:
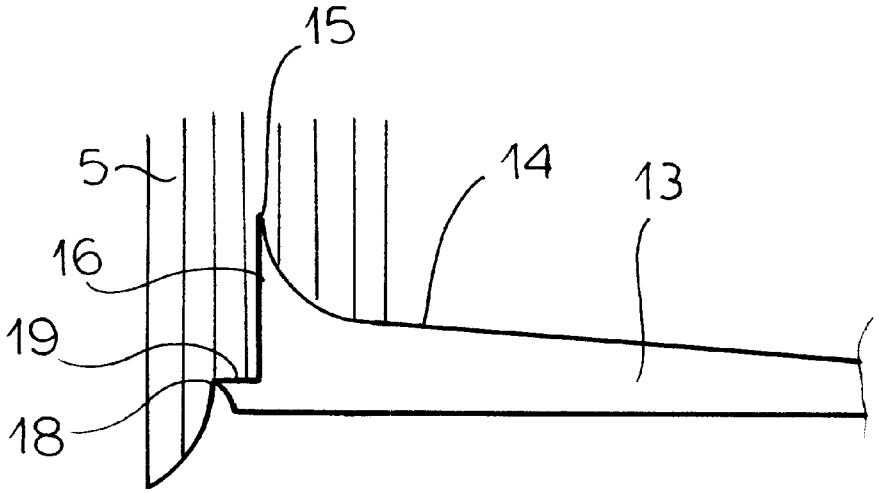

With coating liquids that tend strongly to stick to the lower edge of the guide surface 16 and to flow further on the lower surface of the lower wall 17, the teapot effect is countered by an impingement surface 19 extending perpendicularly inwardly from the guide surface 16 (FIG. 6). The tendency of the coating liquid to stick to the splitter edge 18 of the separator element 13 is proportionately decreased as the flow direction is changed. The impingement surface 19 serves to deflect the downwardly flowing coating liquid on the guide surface 15 first perpendicularly inward. In order to stick to the guide element 13 the coating liquid on flowing around the splitter edge 18 must change direction by nearly 360° . As shown schematically in FIG. 6, this leads to a sure separation of the coating liquid at the splitter edge 18.

Like the guide elements 7, the separating elements 13 preferably have internal cavities 20 to which a coolant is supplied for cooling the surfaces 14, 16, and 19 in contact with the coating liquid. Cooling of the separating element 13 works against cooking on of the coating liquid. Preferably the separating elements 13 are made at least in their regions in contact with the coating liquid of a hollow profile with the above-described curved face so that for cooling sufficient heat exchange is ensured between the contact surfaces 14, 16, and 19 and the coolant-filled internal cavity.

Alternatively to cooling the separating element this can be coated for trouble-free flow of the coating material on its impingement surface 14 with a nonstick material such as for example Teflon.

The width of each separating element parallel to the web-travel direction 3 is such that at least coating liquid flowing from the guide elements is completely intercepted by the catching surface 14. In order to ensure this, the flow-off surfaces 14 of the separating elements 13 are wider than the guide surfaces 8 of the guide elements 7.

What is claimed is:

1. A method of coating a web passing in a horizontal web travel direction beneath a slot nozzle extending transversely of the direction, the method comprising the steps of:

ejecting a pigment-carrying liquid at a flow speed from a slot of the nozzle to form a downwardly free-falling curtain extending across the web;

orienting a vertical inner face of a guide element at each outer edge of the curtain with each face extending from a respective end of the slot downward to adjacent the passing web;

cooling the inner faces of the guide elements; and feeding to an upper region of each of the inner faces a respective partial stream of the liquid such that the partial streams flow down the respective inner faces at a speed at least equal to the curtain flow speed and merge with the outer edges of the curtain.

2. The web-coating method defined in claim 1, further comprising orienting a respective separating element inward of a lower edge of each of the inner faces and thereby splitting off the outer edges of the curtain before they reach the web.

3. The web-coating method defined in claim 2, further comprising the step of cooling the separating elements.

4. A method of coating a web passing in a horizontal web travel direction beneath a slot nozzle extending transversely of the direction, the method comprising the steps of:

ejecting a pigment-carrying liquid at a flow speed from a slot of the nozzle to form a downwardly free-falling curtain extending across the web;

orienting a vertical inner face of a guide element at each outer edge of the curtain with each face extending from a respective end of the slot downward to adjacent the passing web;

orienting a respective separating element inward of a lower edge of each of the inner faces and thereby splitting off the outer edges of the curtain before they reach the web;

cooling the separating elements; and feeding to an upper region of each of the inner faces a respective partial stream of the liquid such that the partial streams flow down the respective inner faces at a speed at least equal to the curtain flow speed and merge with the outer edges of the curtain.

5. The web-coating method defined in claim 4, further comprising the step of cooling the inner faces of the guide elements.

6. An apparatus for coating a web passing in a horizontal web travel direction, the apparatus comprising:

means including a slot nozzle extending transversely of the direction and having a downwardly open slot for ejecting a pigment-carrying liquid at a flow speed from the slot to form a downwardly free-falling curtain extending across the web;

respective guide elements having vertical inner faces at each outer edge of the curtain with each face extending from a respective end of the slot downward to adjacent the passing web;

means for cooling the guide elements; and means for feeding to an upper region of each of the inner faces a respective partial stream of the liquid such that the partial streams flow down the respective inner faces at a speed at least equal to the curtain flow speed and merge with the outer edges of the curtain.

7. The web-coating apparatus defined in claim 6 wherein each inner face has a width measured horizontally in the web-travel direction of at least 10 mm.

8. The web-coating apparatus defined in claim 6 wherein each guide element has a downwardly pointing splitter edge.

9. The web-coating apparatus defined in claim 6, further comprising means including a respective separating element inward of a lower edge of each of the inner faces for splitting off the outer edges of the curtain before they reach the web.

10. The web-coating apparatus defined in claim 9 wherein each separating element has an outwardly inclined upper intercepting surface and a vertical guide surface forming an upwardly directed splitter edge with the upper intercepting surface.

11. The web-coating apparatus defined in claim 9 wherein the guide surfaces of the separating elements each terminate at a lower splitter edge.

12. The web-coating apparatus defined in claim 9 wherein each separating element is formed projecting inward from its guide surface with an upwardly directed secondary intercepting surface.

13. The web-coating apparatus defined in claim 9, further comprising means for cooling the separating elements.

14. An apparatus for coating a web passing in a horizontal web travel direction, the apparatus comprising:

means including a slot nozzle extending transversely of the direction and having a downwardly open slot for ejecting a pigment-carrying liquid at a flow speed from the slot to form a downwardly free-falling curtain extending across the web;

respective guide elements having vertical inner faces at each outer edge of the curtain with each face extending from a respective end of the slot downward to adjacent the passing web;

means including a respective separating element inward of a lower edge of each of the inner faces for splitting off the outer edges of the curtain before they reach the web;

means for cooling the separating elements; and means for feeding to an upper region of each of the inner faces a respective partial stream of the liquid such that the partial streams flow down the respective inner faces at a speed at least equal to the curtain flow speed and merge with the outer edges of the curtain.

15. The web-coating apparatus defined in claim 14 wherein each inner face has a width measured horizontally in the web-travel direction of at least 10 mm.

16. The web-coating apparatus defined in claim 14 wherein each guide element has a downwardly pointing splitter edge.

17. The web-coating apparatus defined in claim 14, a further comprising means for cooling the guide elements.

18. The web-coating apparatus defined in claim 14 wherein each separating element has an outwardly inclined upper intercepting surface and a vertical guide surface forming an upwardly directed splitter edge with the upper intercepting surface.

19. The web-coating apparatus defined in claim 14 wherein the guide surfaces of the separating elements each terminate at a lower splitter edge.

20. The web-coating apparatus defined in claim 14 wherein each separating element is formed projecting inward from its guide surface with an upwardly directed secondary intercepting surface.

* * * * *